US006802630B2

(12) United States Patent
Doppelt

(10) Patent No.: US 6,802,630 B2
(45) Date of Patent: Oct. 12, 2004

(54) OUTDOOR LIGHTING DEVICE

(76) Inventor: Jerald Doppelt, 12 Skyline Dr., North Caldwell, NJ (US) 07006

( * ) Notice: Subject to any disclaimer, the term of this patent is extended or adjusted under 35 U.S.C. 154(b) by 0 days.

(21) Appl. No.: 10/360,045

(22) Filed: Feb. 10, 2003

(65) Prior Publication Data

US 2004/0156200 A1 Aug. 12, 2004

(51) Int. Cl.[7] ..... F21S 1/02

(52) U.S. Cl. ..... 362/414; 362/276; 362/802; 362/431; 362/249; 362/226

(58) Field of Search ..... 362/276, 802, 362/431, 414, 249, 226, 413

(56) References Cited

U.S. PATENT DOCUMENTS 4,228,489 A * 10/1980 Martin ..... 362/250
4,519,657 A * 5/1985 Jensen ..... 439/191
4,827,389 A * 5/1989 Crum ..... 362/388
5,297,013 A * 3/1994 Hall et al. ..... 362/363
5,628,558 A * 5/1997 Iacono et al. ..... 362/288
5,924,787 A * 7/1999 McEllen et al. ..... 362/263
5,954,426 A * 9/1999 Whittington ..... 362/414
6,621,177 B2 * 9/2003 Westcott ..... 307/10.1

* cited by examiner

*Primary Examiner*—Thomas M. Sember
(74) *Attorney, Agent, or Firm*—Lilling and Lilling P.C.

(57) ABSTRACT

The present invention is a lighting device for illuminating backyards, gardens, driveways, sidewalks, patios and other areas outside the house. A top post fits over a lower posts. An electrical cable has one end inserted into a conventional power outlet and its other end passes through the lower post and terminates in a female connector. A second electrical cable passes through the upper post, and has a male plug that is inserted into the female connector. At the other end of this cable are the various lamps, fitted on the top posts.

8 Claims, 3 Drawing Sheets

14
36
18
40
44
21
21
20
46
21
38
22
42
12

OUTDOOR LIGHTING DEVICE

FIELD OF THE INVENTION

The invention relates to the outdoor lighting industry and in particular to a lamppost with a quick disconnect feature.

BACKGROUND OF THE INVENTION

There are many outdoor electric lampposts in the market place. Elegant, attractive and durable, these lampposts illuminate driveways, walkways, and gardens. Installation and relocation of these lampposts is difficult and expensive, as an electrician is typically required to complete the installation. Moreover, if the user does not want continuous operation, he has to remind himself when to turn the lamppost on or off.

The problem with current outdoor lamps is that they are generally permanently wired. This necessarily prevents moving the lamp from place to place. Another problem is that an electrician is needed for installation.

What is needed is a simple to install portable lamppost that can be installed without an electrician or contractor.

SUMMARY OF THE INVENTION

The object of this invention is to provide an inexpensive means to illuminate backyards, patios, driveways, and gardens. Serving not only to project needed light to illuminate dark areas at night, the device adds decor to the surroundings. To ensure unattended operation and to conserve electric consumption, a solar photocell activates the lights upon darkness and deactivates them upon light.

The device in the present embodiment consists of a freestanding base from which a cable supplies a source of power to an upper pole having three light globes. Assembly of the entire unit is achieved by plugging the male plug of the upper pole into the female plug of the lower pole. Rotation of alignment knob joins both units together in their aligned position.

By means of the instant invention, the industry need for a lamppost that can be quickly assembled and has automatic operation is satisfied. Easy to pack, easy to store and easy to move, the device offers unique advantages. The top portion may be easily disconnected from the bottom freestanding base. For storage, the light fixtures are nested around the bottom pole and the light fixture caps are inverted. At the end of a cable leading to the lights in the upper pole, a three prong male plug easily attaches to or disconnects from a female plug on a cable in the bottom pole. Besides the manual on/off switch in the upper pole, an automatic on/off photocell permits unattended operation of the lamppost to provide lighting only when needed. In this way the user also saves on the cost of electricity.

DETAILED DESCRIPTION OF THE INVENTION

Figure 1:
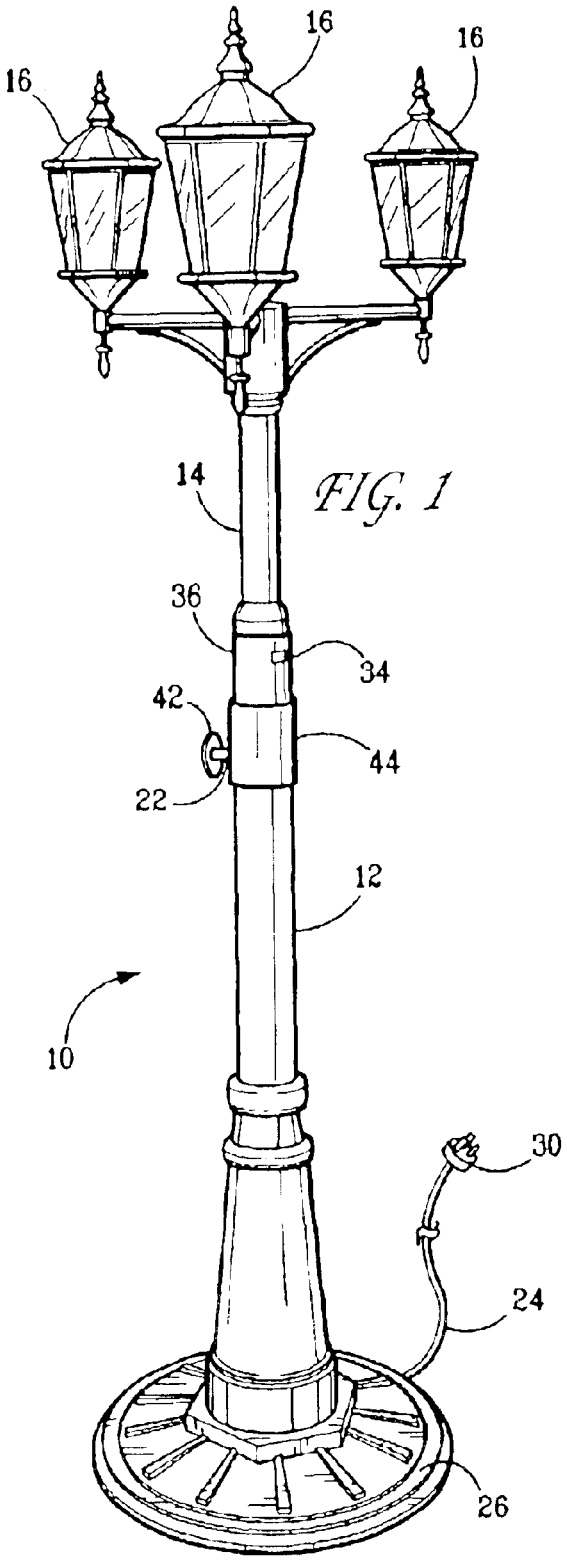
FIG. 1 is a perspective view of assembled lamppost.
Figure 2:
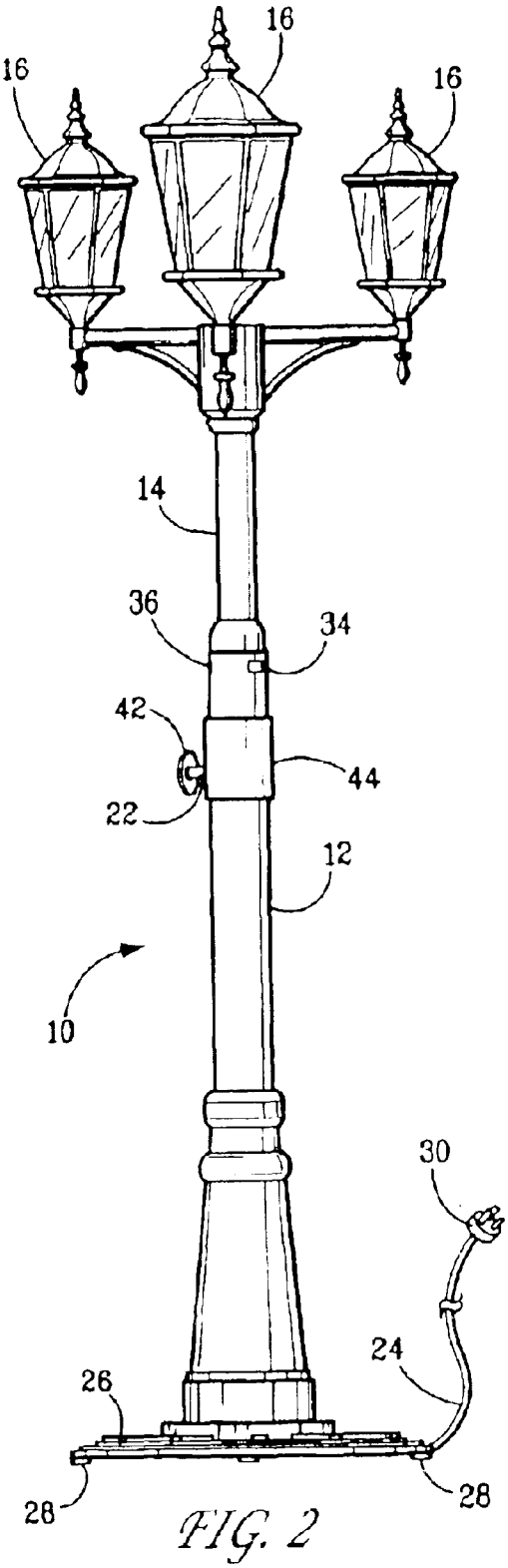
FIG. 2 is an elevational view of assembled lamppost.
Figure 3:
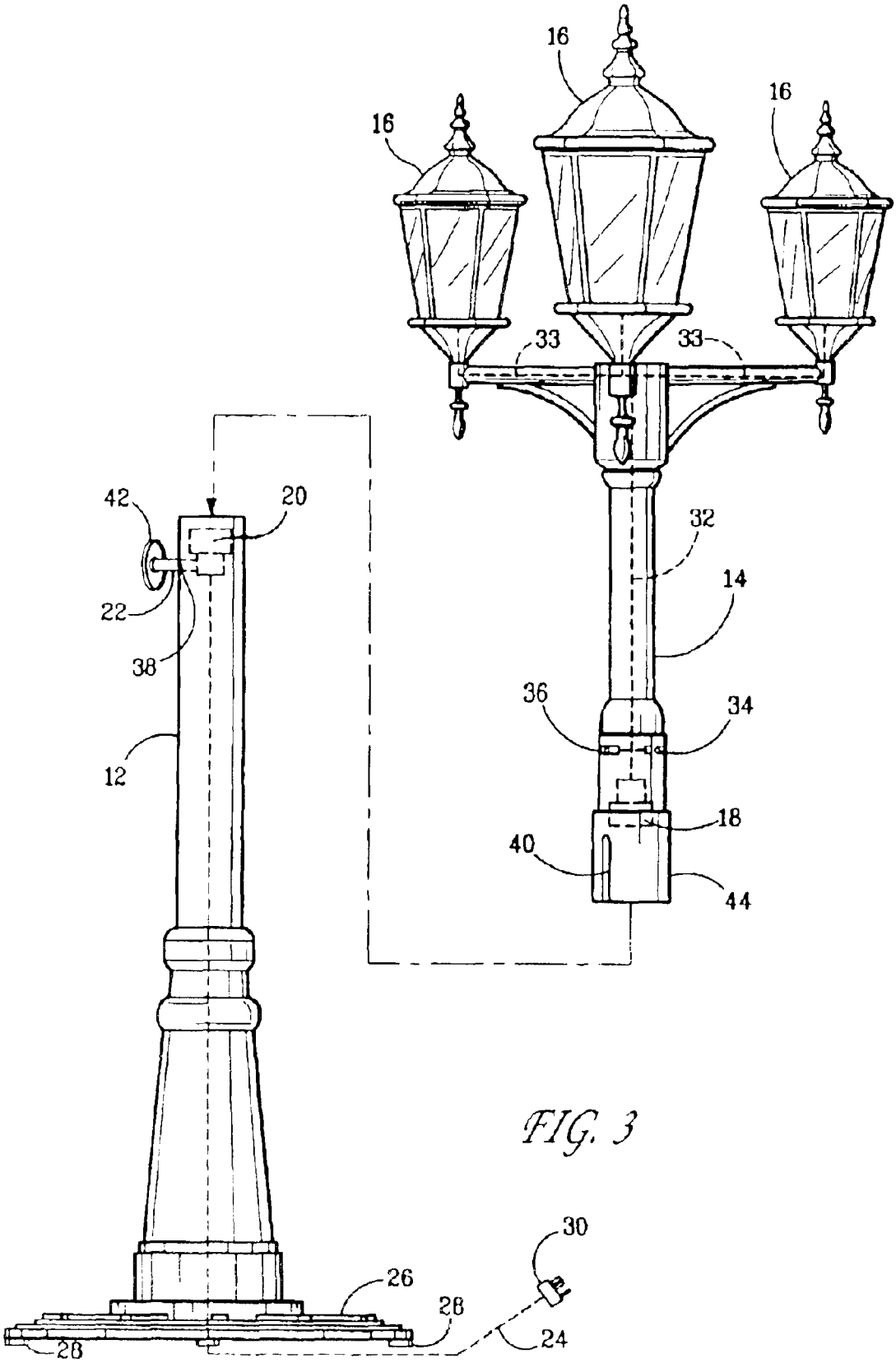
FIG. 3 is an exploded view of dissembled lamppost showing how the top pole is connected to base unit.
Figure 4:
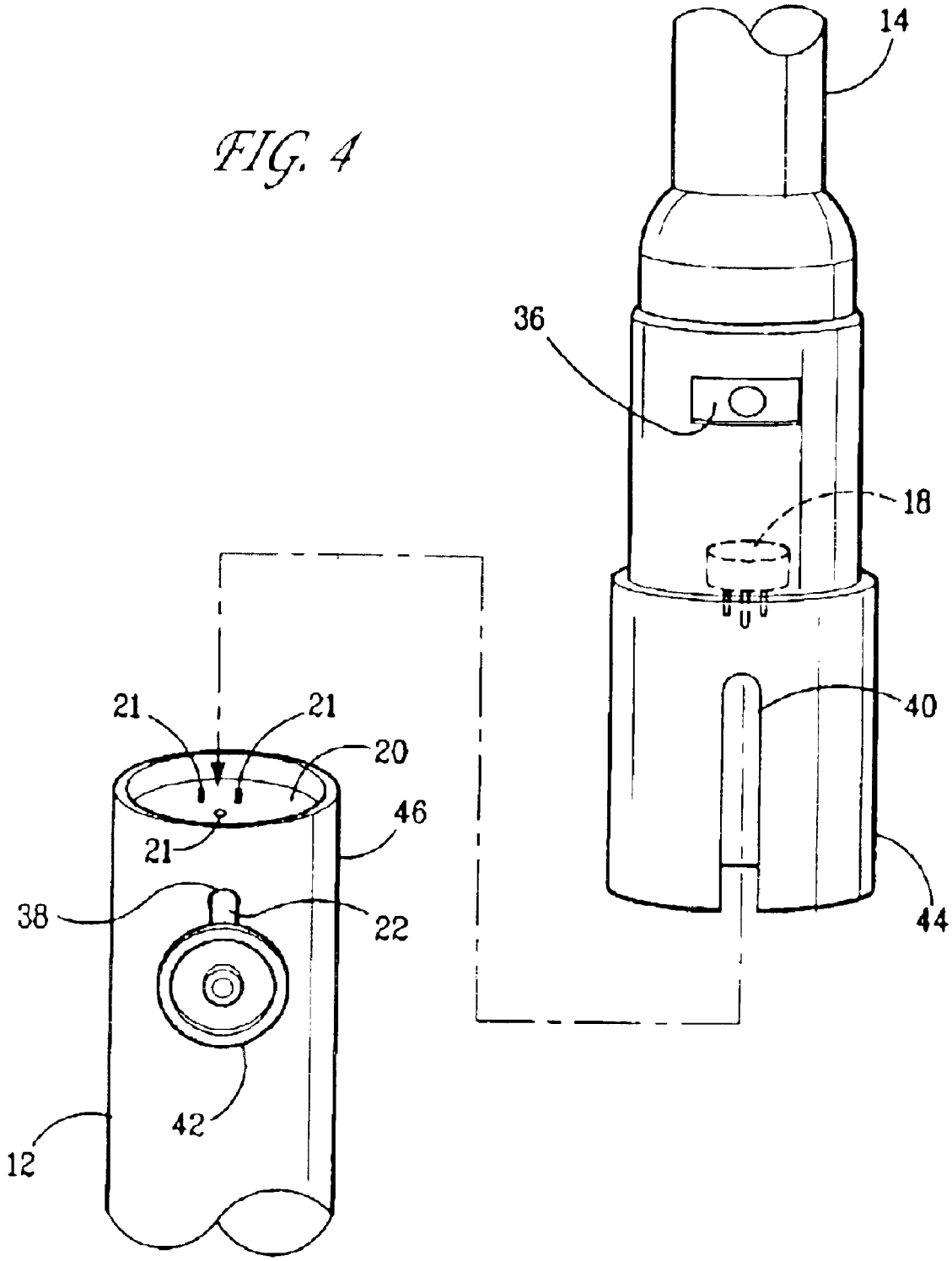
FIG. 4 is an enlarged view of how the male plug in the top pole connects to the female plug in the base unit.

In the preferred embodiment, the device 10 consists of a freestanding lower post 12 from which a cable 24 supplies a source of power to an upper pole 14 having three light globes 16. Assembly of the entire unit is achieved by plugging the male plug 18 of the upper pole 14 into the female plug 20 of the lower pole 12. Rotation of the alignment knob 22 joins both units together in their aligned position.

The invention may have any number and type of lighting fixtures. In the preferred embodiment, there are three spherically shaped traditional globes 16. It may be appreciated that the lamppost of this invention may also have only one or two lighting globes, or even ten. Further, the specific aestestic appearance of the lighting globes will depend on the desired look for the lamppost.

Further, the lamppost may be of any required or desired height. Lampposts of a height of 90.5" work well for path lighting. Any suitable materials may be utilized for the lamppost of this invention. If constructed of aluminum the upper portion of the device is light and noncorrosive. When the base is composed of cast iron, the freestanding base stabilizes the device from tipping over. Weighing only 70–95 pounds, the lamppost is easy to move. It may be appreciated that other shaped globes may be used representing different embodiments of the same invention.

For stability, a base 26 is provided. On its undersurface, any number of feet 28 may be positioned. A cast iron or lead weighted base is most desirable, as it prevents the lamppost from tipping.

In any suitable manner known in the industry, the lower post 12 is secured to the base 26. The power cable 24 enters under the base (or through a side or top opening) and passes internally through the lower post and passes through an interior conduit. At its distil end, a conventional plug 30 is provided on the cord, so it can be inserted in any standard electrical outlet.

At its other distil end, the cord 24 terminates with a conventional female connector 20. As shown, the female connector has three openings 21 for a standard grounded plug.

Passing internally through the upper post 14 within an interior conduit is a power cable 32. As is known in the electrical industry, the cord terminates with small wires 33 feeding the electrical sockets of each of the lighting fixtures or lamps 16.

A standard on-off switch 34 may be provided in the cable 32 (or within the cable 24 in the lower post 12), so that the user can turn the lamps on and off, as required. Preferably, the on/off switch is located in the vicinity where the upper and lower posts are joined. As is known, the switch itself is placed within the circuitry of one of the electrical cables (24 or 32) and the switch button is aligned with an opening in the respective post, so that the user can easily manipulate the switch on the outer surface of the post. Any conventional switch may be used, such as a button switch, slide switch, toggle switch, etc. The other end of the cable 32 terminates in a male plug 18, generally of the 3-pronged grounded type.

A light sensitive photosensor 36 may also be provided within the electrical circuit of the cable 32 (or the cable 24 of the lower post 12). In this manner, when the amount of ambient lights falls below a certain level, the lamps are automatically activated. Conversely, when ambient light increases above a certain level, the lamps can be turned off Instead of, or in addition to, a light sensitive sensor, a motion sensor may be used, so that the lamps are activated when there is physical activity in the area.

In a preferred embodiment, the on/off switch may be illuminated to facilitate using it in the dark.

To assemble the two posts, the upper post 14 is held above the lower post 12, and the male connector 18 is inserted into the female connector 20. To further secure the posts together, a bolt 22 passes through an opening 38 in the lower post 12 and is held securely within a corresponding slot or opening 40 in the upper post 14. As is known, the bolt 22 can pass all the way through the upper post, or it may be threaded into it. An enlarged head 42 may be provided to facilitate handling the bolt.

Preferably, the lower portion 44 of the upper post 14 has an enlarged diameter, so that it will fit over the lower post 12. The length of the enlarged diameter portion 44 is selected so that enough of the top portion 46 of the lower post 12 fits within the upper post 14, so that the post do not come apart and will hold up in a steady, stable manner. The bolt 22 serves the function of preventing separation of the upper and lower posts.

The invention is described in detail with reference to a particular embodiment, but it should be understood that various other modifications can be effected and still be within the spirit and scope of the invention.

I claim:

1. An outdoor lighting device consisting of an upper post having at least one electrical lamp and a lower portion of said upper post having an enlarged diameter; a first electrical cable having a first end connected to said at least one electrical lamp and a second end with an electrical connector, said first electrical cable extending through an interior of said upper post; a lower post removably connected to said upper post, wherein a top portion of said lower post fitting into said enlarged diameter portion of said upper post; a bolt that passes through said top portion of said lower post and said lower portion of said upper post; and a second electrical cable having a conventional electrical plug on a first end for connection to an external power source and a second end with an electrical connector for removable connection to said electrical connector of said first electrical cable, said second electrical cable extending through an interior of said lower post.

2. An outdoor lighting device according to claim 1, wherein an on/off switch is provided in said first electrical cable.

3. An outdoor lighting device according to claim 2, wherein said on/off switch is illuminated.

4. An outdoor lighting device according to claim 1, wherein a solar photosensor is provided in said first electrical cable to activate and/or deactivate the lighting device based on the level of ambient light.

5. An outdoor lighting device according to claim 1, wherein an on/off switch is provided in said second electrical cable.

6. An outdoor lighting device according to claim 5, wherein said on/off switch is illuminated.

7. An outdoor lighting device according to claim 1, wherein a solar photosensor is provided in said second electrical cable to activate and/or deactivate the lighting device based on the level of ambient light.

8. An outdoor lighting device according claim 1, further comprising a motion detector cable to activate and/or deactivate the lighting device based on the level of activity in the vicinity of the lighting device.

* * * * *